US006493217B1

(12) United States Patent
Jenkins, Jr.

(10) Patent No.: US 6,493,217 B1
(45) Date of Patent: Dec. 10, 2002

(54) MOBILE WORKSTATION WITH POWER SUPPLY SYSTEM

(76) Inventor: Harris L. Jenkins, Jr., 6370 Falla Dr., Canal Winchester, OH (US) 43110

( * ) Notice: Subject to any disclaimer, the term of this patent is extended or adjusted under 35 U.S.C. 154(b) by 139 days.

(21) Appl. No.: 09/702,624

(22) Filed: Oct. 31, 2000

(51) Int. Cl.[7] ..... H05K 5/00

(52) U.S. Cl. ..... 361/683; 312/223.2; 312/197; 108/147; 606/202

(58) Field of Search ..... 361/683, 680–682; 312/223.1–223.6, 208.1, 197; 108/50.14, 3, 147, 25; 606/32

(56) References Cited

U.S. PATENT DOCUMENTS

| | | | | | |
|---|---|---|---|---|---|
| 5,287,815 | A | * | 2/1994 | Gross | 108/50 |
| 5,443,017 | A | * | 8/1995 | Wacker et al. | 108/3 |
| 5,697,686 | A | | 12/1997 | Miller et al. | |
| 5,806,943 | A | | 9/1998 | Dell et al. | |
| 5,868,079 | A | | 9/1999 | Charny | |
| 6,086,073 | A | * | 7/2000 | Tisbo et al. | 280/47.26 |

* cited by examiner

*Primary Examiner*—Darren Schuberg
*Assistant Examiner*—Hung Van Duong
(74) *Attorney, Agent, or Firm*—Kremblas, Foster, Phillips & Pollick

(57) ABSTRACT

In accordance with this invention an improved mobile workstation is provided. The workstation has a base frame, a housing attached to the frame, a vertical upright portion also attached to the frame, and a horizontal member having a work surface with the horizontal member being attached to the vertical upright portion. The base frame has a top and a bottom, with the bottom having wheels attached thereto. The housing contains a portable power supply, a battery, a DC/AC converter, a switch, an external outlet, and circuitry, with the circuitry connecting the power supply to the switch and the power supply to an external plug, the switch to the battery, the switch to at least one female connector, and the DC/AC converter to the external outlet. The vertical upright portion extends higher than, or above, the housing, and in the preferred embodiment of the invention, has a locking mechanism to control the height of the horizontal member above the base frame. Preferably the switch has three positions, one position for recharging the power supply, one position for allowing power to flow through the converter from the battery to the external outlet, and one off position. The switch preferably is connected to at least one indicator light.

20 Claims, 4 Drawing Sheets

MOBILE WORKSTATION WITH POWER SUPPLY SYSTEM

FIELD OF THE INVENTION

The present invention relates generally to a mobile workstation, and more particularly, to one which contains its own power supply and is used primarily in conjunction with a laptop computer or personal computer.

BACKGROUND OF THE INVENTION

The records storage industry involves not only the storage of thousands upon thousands of records in large warehouse settings, but also the updating of those records once in storage. The individuals in charge of overseeing the retention and custody of those records typically work at a desk located adjacent the stored records in an area having a computer. When it becomes necessary to update a stored record or check on the file itself, one of two methods is often utilized.

Under the first method, which is the most common, an individual walks from the clerical employee's desk to the specific location of the file. The file is then removed and taken back to the individual's desk. The file is then worked on and subsequently returned to its correct place in the warehouse. Considering the size of the files, the number that may require work on any given day, and the size of these warehouse type structures, a considerable amount of time and effort must be expended in this venture.

In the second method, an individual transports a cart into warehouse, locates several files which need attention, transports them all back to the central clerical work area on the cart, types any information change onto the computer system, and then transports the files back into storage using a cart. While this method is initially attractive due to a perceived savings of time, more concentrated lifting is involved and the employee's desk may become cluttered with a plurality of files possibly resulting in the potential for a clerical error.

One way in which workers may try to obviate the repeated trips into and out of the file storage area is to manually enter the information into the file at its point of storage using a pen or pencil, and then enter the same information into the computer system once they have returned to their desks. However, given the lighting in most storage areas, it is easy for transcription errors to occur.

While some workers who utilize the preceding method also use a laptop computer in the storage stacks, the carts typically used to transport files do not have enough room for both files and a computer, much less have a power supply as part of the cart. Alternatively, existing mobile computer carts typically do not have enough room on their upper surface for a plurality of stored files to be worked on when the cart is in the storage area.

Consequently, it would be beneficial for clerical workers to have access to a mobile workstation complete with a keyboard and monitor, as well as a power supply and transmitting capabilities to enable the entering of data in the area of the files to be simultaneously stored on the central computer system. While workstations or carts similar to the desired product are known, they have not been embraced by clerical workers. Examples of such products include, Dell, U.S. Pat. No. 5,806,943, Charny, U.S. Pat. No. 5,868,079, and Miller et al., U.S. Pat. No. 5,697,686.

It is thus apparent that the need exists for an improved mobile workstation.

SUMMARY OF THE INVENTION

In accordance with this invention an improved mobile workstation is provided. The workstation has a base frame, a housing attached to the frame, a vertical upright portion also attached to the frame, and a horizontal member attached to the vertical upright portion. The base frame has a top and a bottom, with the bottom having wheels attached thereto. The wheels may have braking means (not shown).

The housing contains a portable power supply, a battery, a DC/AC converter, a switch, an external outlet, and circuitry, with the circuitry connecting the power supply to the switch and the power supply to an external plug, the switch to the battery, the switch to at least one female connector, and the DC/AC converter to the external outlet. The external plug preferably is attached to a retractable electrical cord.

The vertical upright portion extends higher than, or above, the housing. In the preferred embodiment of the invention, the vertical upright portion has a locking mechanism to control the height of the horizontal member above the base frame. Additionally, the horizontal member has positioned thereon a work surface.

Preferably the switch has three positions, one position for recharging the power supply, one position for allowing power to flow through the converter from the battery to the external outlet, and one off position. Preferably, the switch is also connected to at least one indicator light, and in the preferred embodiment of the invention is connected to two indicator lights.

Preferably, the housing includes in its interior at least one shelf. Additionally, preferably the battery is a gel-filled battery. The workstation may have a computer thereon, with the computer preferably being a laptop. The computer may have wave access, and can be secured to said horizontal member. The horizontal member preferably has a hand-rail, the hand-rail being located around the periphery of the horizontal member.

There is also disclosed a mobile workstation having a base frame and a housing. The base frame has a top and a bottom, with wheels being attached thereto. The housing is secured to the base frame.

The housing encloses a portable power supply, a battery, preferably a gel-filled battery, a DC/AC converter, a switch, an external outlet, and circuitry, with the circuitry connecting the power supply to the switch and the power supply to an external plug, the switch to the battery, the switch to at least one female connector, and the DC/AC converter to the external outlet.

The switch preferably has three positions, one position for recharging the power supply, one position for allowing power to flow through the converter from the battery to the external outlet, and one off position. The switch preferably is connected to at least one indicator light, and more preferably two indicator lights.

There is also disclosed a mobile workstation having a base frame, a housing secured to the base frame, a vertical upright portion attached to the base frame and extending above the housing, and a horizontal member. The base frame has a top and a bottom, with the bottom having wheels attached thereto. The horizontal member has positioned thereon a work surface. The vertical upright portion has a locking mechanism to control the height of the horizontal member above the base frame.

The housing encloses a portable power supply, a gel-filled battery, a DC/AC converter, a switch, an external outlet, and circuitry. The circuitry connects the power supply to the switch and the power supply to an external plug, with the power supply connected to the external plug preferably by a retractable electrical cord. The circuitry also connects the switch to the battery, the switch to at least one female connector, and the DC/AC converter to the external outlet.

Preferably, the switch has three positions, one position for recharging the power supply, one position for allowing power to flow through the converter from the battery to the external outlet, and one off position, with the switch being connected to at least one indicator light.

In one embodiment of the invention, the work surface has a computer thereon. Also, the housing includes in its interior at least one shelf. Additionally, the horizontal member preferably has a hand-rail located around the periphery of the horizontal member.

The primary objective of this invention is to provide a mobile workstation which can be used in the maintenance of stored records to enable more work to be done in less time, more accurately, and with less possibility for on the job injury.

Another objective is to provide a system which is relatively easy to use.

Other objects and advantages of the invention will be apparent from the following description, the accompanying drawings, and the appended claims.

DETAILED DESCRIPTION OF THE DRAWINGS

Figure 1:
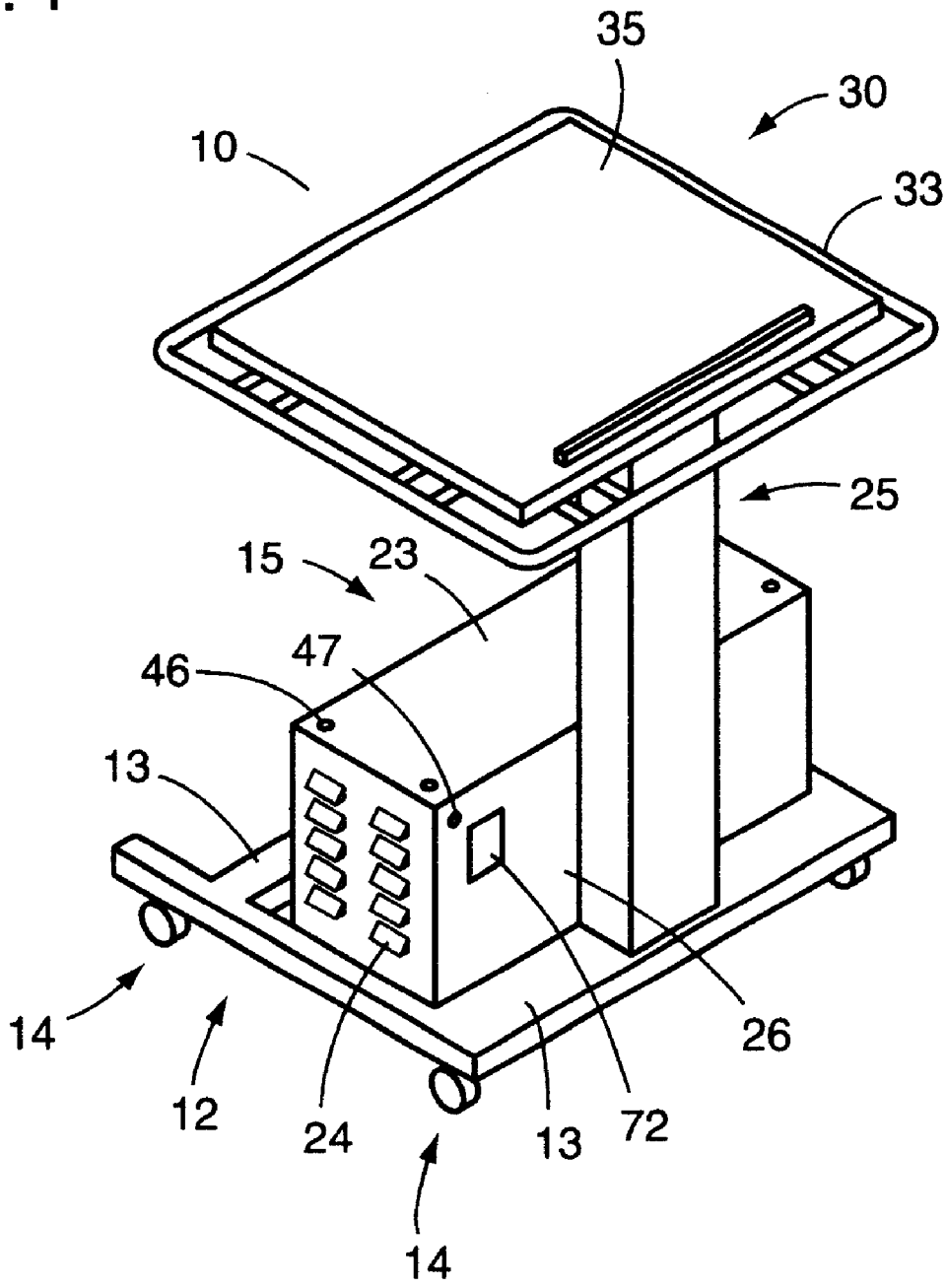
FIG. 1 is a perspective view of a mobile workstation made in accordance with the present invention.
Figure 2:
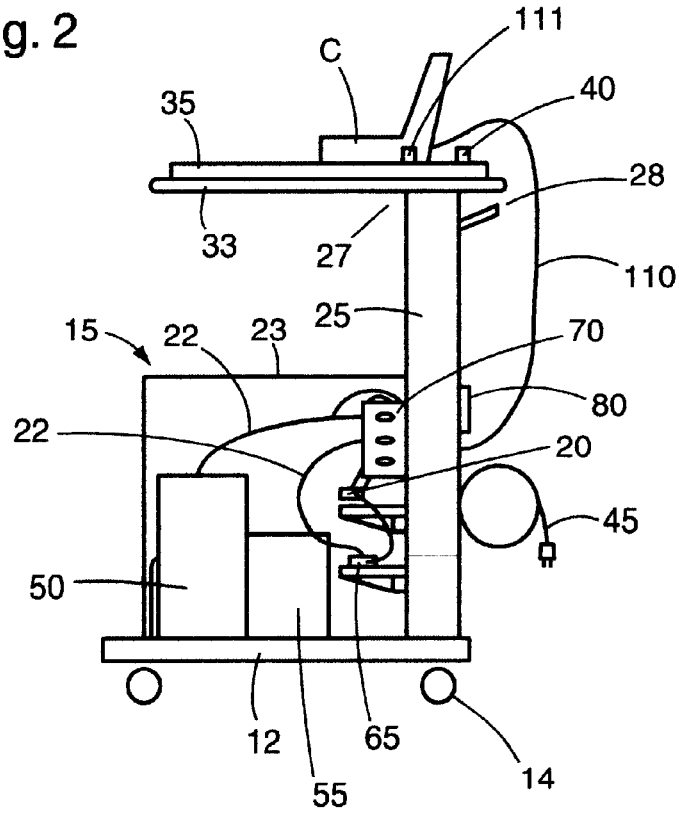
FIG. 2 is a schematic diagram taken from the right side of the invention and showing the internal components of the housing.
Figure 3:
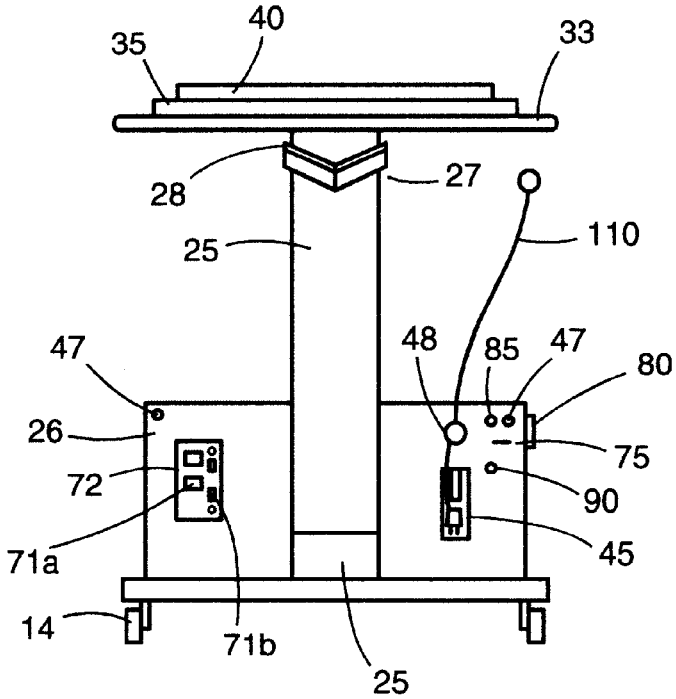
FIG. 3 is a rear elevational view of the invention.

Having reference to the drawings, attention is directed first to FIGS. 1 through 3 which disclose a perspective, schematic, and rear elevational view, respectively, of the invention, which invention is designated generally by the numeral 10. The apparatus 10 sits upon a base frame 12 preferably fabricated from hollow metal bars, such as steel or heavy aluminum. A plurality of crossbars 13 extend across the frame, with the number of crossbars in the preferred embodiment of the invention being four. Secured to the lower surface of the base frame are a plurality of wheels 14 in the form of caster units, preferably four in number, such that the frame is balanced to avoid tipping. The wheels may have typical breaking means (not shown).

As can be appreciated best from FIG. 1, at the upper rear surface of the base frame 12, a housing 15 is secured. The housing is preferably fabricated from sheet metal, although a heavy plastic could also be used. The housing 15 has four sidewalls and preferably forms the shape of a rectangular block. Inside the housing is housed a portable power supply 16, a battery 18 preferably gel-filled with battery posts 19, a DC/AC converter 20, and appropriate circuitry 22.

The portable power supply 16, battery 18, DC/AC converter 20, and circuitry are all well known, and in of themselves do not constitute invention with respect to their composition. For example, the portable power supply could be a triple charge, slow charging engine starter or battery charger such as a DIEHARD® 10/2/60 amp charger, the battery could be a GUARDIAN® non-spillable lead acid battery, and the converter could be a COMPAQ® ARMADA® automobile/aircraft adapter or power inverter which changes DC current into AC current for subsequent use by a computer.

As can best be appreciated from a comparison of FIGS. 1 and 3, housing 15 has a lid 23 and vents 24, with the vents being shown as horizontal and parallel. The device 10 also has a vertical upright portion 25 which typically is formed so as to be telescoping, thereby permitting height adjustment for the workstation. The vertical upright portion 25 is located adjacent the housing back wall 26 and is secured to the base frame 12. At the top 27 of the vertical upright portion 25 is a locking mechanism 28 of the type well known in connection with such structures, which locking mechanism permits the height of the upright portion to be adjusted and then secured at the selected level. The concept and structure for the vertical upright portion have their basis in the tray tables used in hospital rooms, themselves having height adjustment. A recent patent showing such a mechanism is Russo et al., U.S. Pat. No. 4,401,036, although earlier types of such adjustable tray tables disclose mechanisms which would work in the instant invention.

To prevent the work surface from rocking from side to side, a tracking guide 29 may be installed so as to work in conjunction with the vertical upright member 25. The tracking guide 29 includes a pair of holes drilled into the back sidewall of the outer telescoping vertical upright portion, with the holes spaced apart a distance slightly greater than the width of the interior telescoping vertical upright portion. A screw passing through each hole is secured to an arm with a spacer unit, possibly a nylon, plastic, or rubber cylinder held onto the end of the arm by a washer and nut. The pair of spacer tools cooperates to prevent rocking during use.

Attached to the top 27 of the vertical upright portion 25 is horizontal member 30. The horizontal member 30 is preferably formed of two pairs of intersecting members 32 with a hand-rail 33 forming the periphery and encircling the horizontal member. The hand-rail is attached to the two pairs of intersecting members. As such it can be appreciated that the intersecting members extend from the front to the back and from one side to the other respectively. The horizontal member and hand-rail are preferably formed of sheet metal, such as metal plates or more preferably angle iron, although they could be fabricated from a heavy plastic. The horizontal member, if metal, can be welded or soldered to the top of the vertical upright portion.

Atop the horizontal member 30 is work surface 35, which can be appreciated as being planar. The work surface could fabricated from a wood, laminate, or plastic member secured in place to the horizontal member 30 by screws or other appropriate fastening means. Near the rear of the work surface is a retaining bar or backstop 40 in the form of an elongated bar, which prevents objects from falling off the back of the work surface. As shown, the retaining bar 40 is of a width less than that of the work surface itself.

Also attached to the rear of the housing is an electrical cord 45, which is best shown in FIGS. 2 and 3. The cord is shown as being in a container which automatically retracts the AC extension cord for purposes of storage. The cord 45 passes into housing 15 through cord aperture 48 located in the rear wall 26 of the housing 15. The cord aperture is shown as a relatively large circle, through which a plurality of cords may be inserted. Near the cord aperture is one of at least two access apertures. These smaller apertures are large enough to permit a finger to be inserted therethrough to facilitate the lifting of lid 23 when fasteners 46 are removed from their locations in the lid, as can best be seen in FIG. 1.

Figure 4:
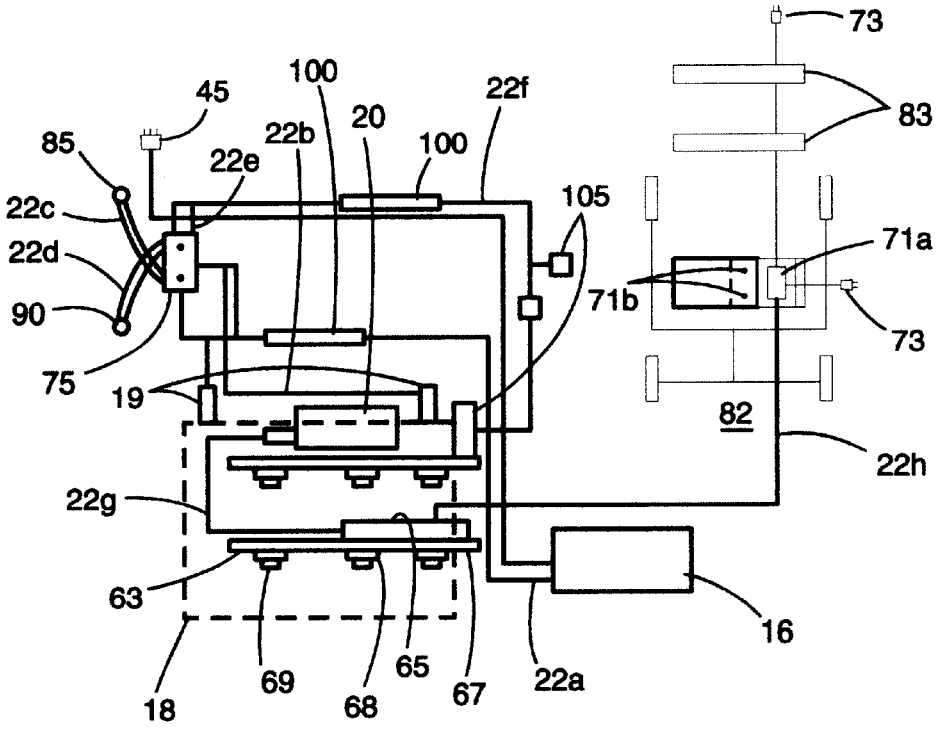
FIG. 4 is a schematic primarily of the electrical circuitry of the invention, but also showing some of the other components inside the housing.

Inside the housing 15 as can best be seen by comparing FIGS. 2 through 4 is a battery 18 of the type mentioned above. Also inside the housing is a charger 16. A first shelf 63 is secured to the rear wall 26. On this upper shelf rests a DC/AC converter 20. A power strip 65 rests on a second shelf 67 located beneath the first shelf 63. Each of the shelves is attached to the rear wall of the housing at a plurality of slot forming housings 68. Each slot forming housing 68 forms a substantially rectangular slot into which a plurality of downwardly extending flanges 69 slide. As can best be seen in FIG. 4, the number of flanges 69 and slot forming housings 68 is three for each of the two shelves. Although not shown, a number of D-rings may be attached to the interior of the housing's inner walls to assist in holding the components in place through the use of straps. As attached, the D-rings preferable pivot in all directions about their point of attachment.

Also secured to the housing back wall 26 is an outlets box 70, equipped with a multi-access power distribution system 71 featuring, in the preferred embodiment of the invention, electrical sockets 71*a* and phone outlets 71*b*. The exterior rear of the housing discloses that the outlets box 70 is covered with an outlets plate 72.

The exterior rear of the housing also features a 3-way switch 75 which extends outwardly from the plane of the housing. To prevent the switch from being crushed or otherwise easily damaged, a protective plate 80 is provided attached to the side of the housing 15 and projecting rearwardly enough to deflect potentially damaging objects from coming into contact with the switch 75. To show that the switch is flipped into the upper position, a green LED 85 is positioned slightly above the switch and will be lit when the switch 75 is so flipped. If the green light is on, then 12V of power flowing from the battery 18 to the switch through the inverter/converter and is being sent to the power strip and thence to the computer/laptop. To show that the switch is flipped into the lower position, a red LED 90 is positioned just slightly below the switch. If the red light is on, the battery of the invention is recharging.

Before discussing the circuitry associated with the operation of the invention, the means of attachment of the outlets box 70 deserves passing comment. As can best be appreciated from FIG. 4, a pair of socket support anchors 82 serves as the end supports for a slotted socket support plate 83. The height of these slotted support plates above the base frame can be adjusted with respect to each pair of socket support anchors. The adjustability of the support plates, coupled with the slots in them permits any outlet box to be secured in place, since the outlet box can have the support anchors vary the vertical places of attachment while the slots in the support plates provide for horizontal adjustment.

The workstation may have a computer C positioned on its work surface as shown in FIG. 2. Preferably the computer would be a laptop or mini-PC secured by a cable lock to the workstation itself. A supplemental cord 110 connects the computer to the power supply. In cases where a laptop is used, a means of providing radio wave access 111 (such as by a radio card) to an antenna is attached or incorporated into the laptop. Devices which provide radio wave access are well known in the art and are commonly available where computers are sold.

The circuitry of the workstation of this invention may be appreciated from a review of FIG. 4. An electric cord 45 brings power to a portable power supply 16. Circuitry 22*a* connects the power supply 16 to the switch 75 through the use of butt connector 100. The switch is also connected by circuitry 22*b* to battery 18. Circuitry 22*c* connects the switch to the green LED 85, while circuitry 22*d* connects the switch to the red LED 90.

When the switch is on, circuitry 22*e* and 22*f* provides power through the use of butt connector 100 to one of the two female connectors 105 shown, one of which female connectors is connected to the inverter/converter, and the other of which female connector may be visible on the exterior of the back wall or which may be accessed solely through the cord aperture 48. Circuitry 22*g* connects the DC/AC converter to the power strip, while circuitry 22*h* connects the power strip to the multi-access power distribution system 71. If the switch is in the middle position, then no power is flowing through the system, i.e. everything is off.

Figure 5:
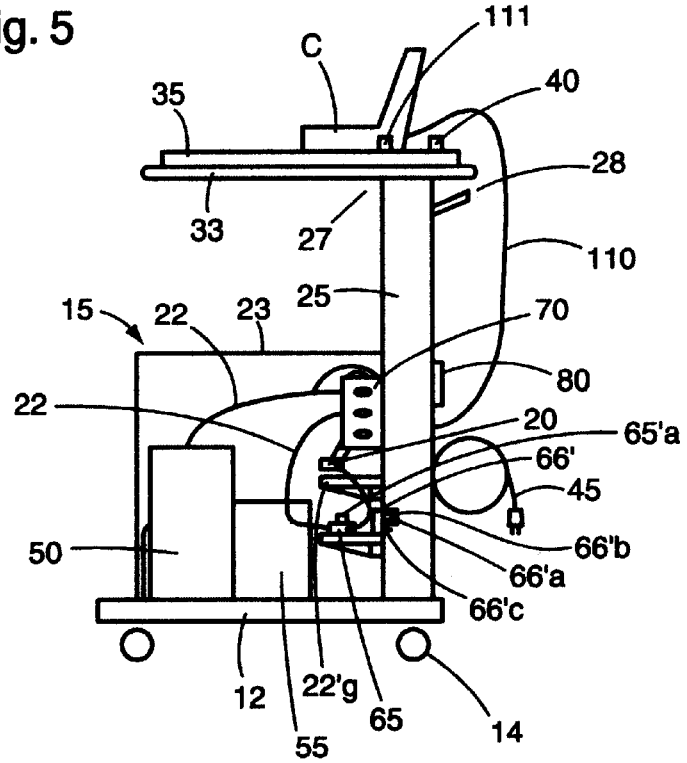
FIG. 5 is a schematic diagram similar to FIG. 2, but showing a modified power strip developed for use as part of the invention.

FIG. 5 discloses a modified embodiment of the invention featuring a unique power strip. For the most part the system is quite similar to the invention as disclosed in FIGS. 2 through 4. Inside the housing 15 is a battery 18 of the type mentioned above. Also inside the housing is a charger 16. On the first shelf 63 rests a DC/AC converter 20. Circuitry 22'*g* plugged into the converter connects the DC/AC converter 20 to a unique harness which includes a power strip 65' which rests on second shelf 67 located beneath the first shelf 63.

As before, each of the shelves is attached to the rear wall of the housing at a plurality of slot forming housings identical to those shown in FIG. 4. In this unique harness component, circuitry 22'*g* between the converter and the power strip 65' is connected to a fuse buse or fusebox 66' secured to the rear wall 26. Extending through the rear wall 26 is a fuse 66'*a* with a removable or pivotable cover 66'*b* to protect the fuse. Also extending outwardly through the rear wall is a reset switch 66'*c*, which switch is connected to the fuse box.

The circuitry 22'*g* from the fuse box 66 then is connected to power strip 65'. A surge protector 65'*a* is plugged into power strip 65'. The purpose of this surge protector 65'*a* is to protect the internal power supply in the event that too much current is attempted to be pulled through the system, thereby overworking the system. The manual switch 66'*c* permits the power strip to be reset from the exterior of the housing when the surge protector is tripped. Circuitry 22'*g* then goes from the surge protector 65'*a* to outlets box 70 secured to the housing back wall 26.

The outlets box 70 is equipped with a multi-access power distribution system 71. However, in the modified embodiment a ground fault interrupt (GFI) electrical socket 71'*a* is used instead of a regular electrical socket. Since this socket is external, by using a GFI socket, it will trip the fuse in case it comes into contact with water. Like typical GFI sockets, there is an external reset button on the socket itself. Once again, the exterior of the outlets box 70 is covered with an outlets plate.

In actual use, the mobile cart and power supply system of this invention is of particular use by clerical employees who work in warehouses where large numbers of files are stored, such as workers' compensation, insurance claims, or legal.

Using this system, an individual can plug a lap top computer with transmitting capabilities into the cart's portable power supply. The individual may then roll the cart through the warehouse and enter data from a file into the computer system at the file's location in the warehouse. One somewhat unexpected advantage associated with this invention is the reduction in paper occasioned by having a computer system on the workstation which can download searching information from a central computer. Because of the realtime access to requests for files to be pulled for updating, one location where the invention has been tested has estimated that yearly savings in sheets of FAXes will be on the order of 80,000 sheets of paper.

In addition to being much quicker than the current procedure, use of this cart eliminates the lifting of files, as well as the excessive walking on hard, typically concrete, floors. In fact, at one location where the invention has been installed, the entity running the location includes money for comfortable shoes as part of its budget. Furthermore, due to the savings of time involved, fewer workers are able to accomplish as much work in the same amount of time, thus a company or agency is able to significantly reduce its number of clerical staff as well as reduce medical problems attendant with the lifting of files and considerable walking on hard surface floors.

For example, a GN netcom ellipse 24 wireless phone, such as a model 1600-539 can be connected by a phone cord or a wireless antenna to the workstation. The workstation can be connected to a phone outlet on a wall of the room where it is used or to a cell phone. The extra internal female connector can be exposed to the outside of the housing to permit appliances such a cell phones to be recharged.

Figure 6:
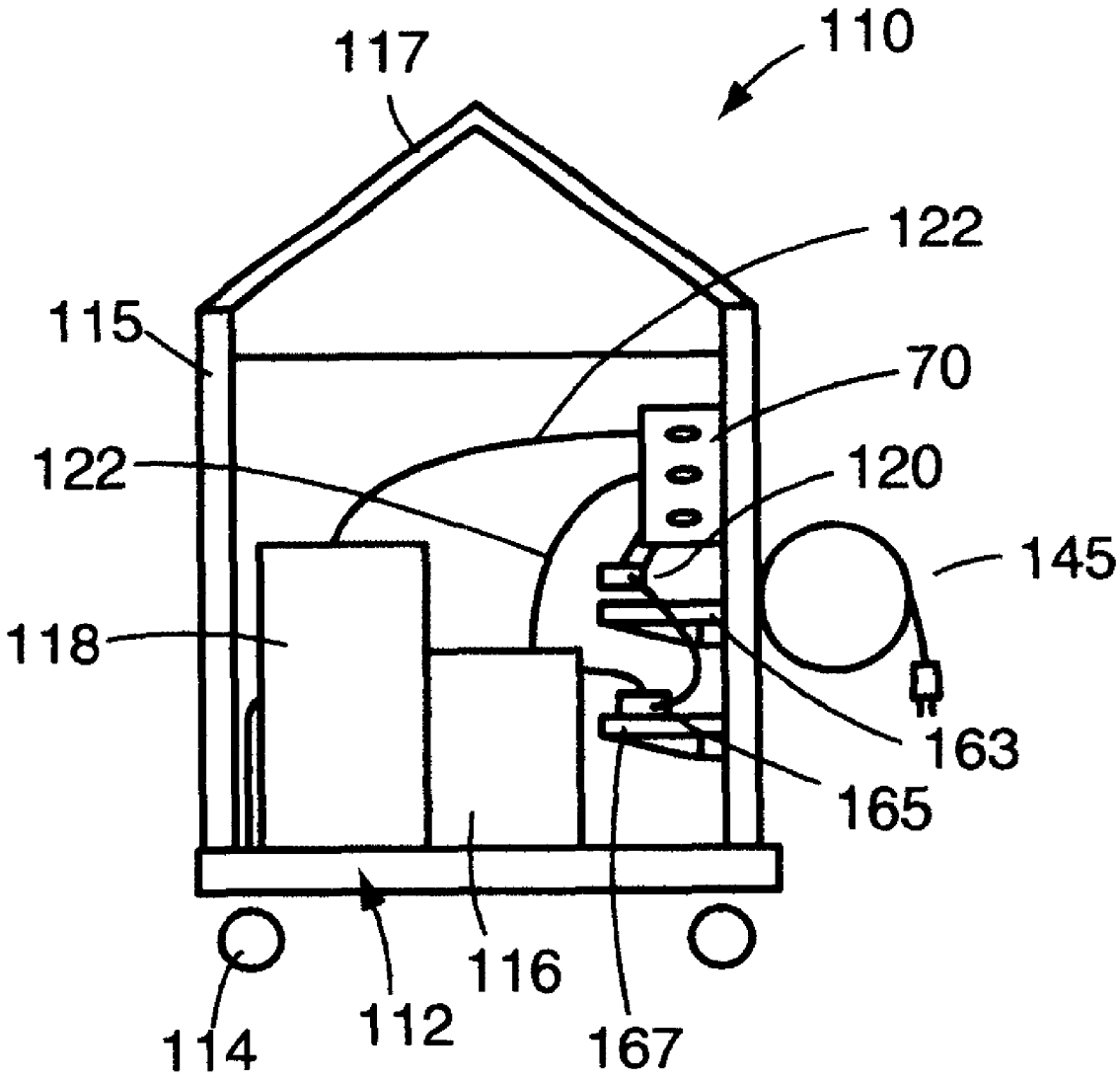
FIG. 6 is a schematic similar to FIG. 2, but of a modification of the invention.

A modified embodiment of the invention is shown in FIG. 6. In this drawing figure, the device 110 has a base frame 112, wheels 114, and a housing 115 in which is located a portable power supply 116 and a battery 118. There is also a DC/AC converter 120, with all the electrical components being connected by the same circuitry 122 as set forth above. However the housing 115 also has a handle component 117 which extends upwardly above the housing and assists in moving of the device. This embodiment also has an electric cord 145, a first shelf 163 and a second shelf 167, with the first shelf having a converter 120 rest thereon, while the second shelf has a power strip 165 rest thereon. The components shown in a comparison of FIGS. 2 through 4 may also be incorporated into this modified embodiment.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A mobile workstation comprising a base frame, said base frame having a top and a bottom, said bottom having wheels attached thereto, a housing, said housing secured to said base frame, said housing enclosing a portable power supply, a battery, a DC/AC converter, a switch, an external outlet, and circuitry, said circuitry connecting said power supply to said switch and said power supply to an external plug, said switch to said battery, said switch to at least one female connector, and said DC/AC converter to said external outlet, a vertical upright portion, said vertical upright portion being attached to said base frame and extending above said housing, and a horizontal member, said horizontal member having positioned thereon a work surface, said vertical upright portion having a locking mechanism to control the height of said horizontal member above said base frame.

2. The device of claim 1 wherein said switch has three positions, one position for recharging the power supply, one position for allowing power to flow through the converter from said battery to said external outlet, and one off position.

3. The device of claim 1 wherein said battery is a gel-filled battery.

4. The device of claim 1 wherein said switch is also connected to at least one indicator light.

5. The device of claim 1 wherein said switch is also connected to two indicator lights.

6. The device of claim 1 wherein said workstation has a computer thereon.

7. The device of claim 1 wherein said housing includes in its interior at least one shelf.

8. The device of claim 1 wherein said horizontal member has a hand-rail.

9. The device of claim 1 wherein said hand-rail is located around the periphery of said horizontal member.

10. The device according to claim 1 wherein said external plug is attached to a retractable electrical cord.

11. A mobile workstation comprising a base frame, said base frame having a top and a bottom, said bottom having wheels attached thereto, a housing, said housing secured to said base frame, said housing enclosing a portable power supply, a battery, a DC/AC converter, a switch, an external outlet, and circuitry, said circuitry connecting said power supply to said switch and said power supply to an external plug, said switch to said battery, said switch to at least one female connector, and said DC/AC converter to said external outlet.

12. The device of claim 11 wherein said switch has three positions, one position for recharging the power supply, one position for allowing power to flow through the converter from said battery to said external outlet, and one off position.

13. The device of claim 11 wherein said battery is a gel-filled battery.

14. The device of claim 11 wherein said switch is also connected to at least one indicator light.

15. The device of claim 11 wherein said switch is also connected to two indicator lights.

16. A mobile workstation comprising a base frame, said base frame having a top and a bottom, said bottom having wheels attached thereto, a housing, said housing secured to said base frame, said housing enclosing a portable power supply, a gel-filled battery, a DC/AC converter, a switch, an external outlet, and circuitry, said circuitry connecting said power supply to said switch and said power supply to an external plug through a retractable electrical cord, said switch to said battery, said switch to at least one female connector, and said DC/AC converter to said external outlet, a vertical upright portion, said vertical upright portion being attached to said base frame and extending above said housing, and a horizontal member, said horizontal member having positioned thereon a work surface, said vertical upright portion having a locking mechanism to control the height of said horizontal member above said base frame.

17. The device of claim 16 wherein said switch has three positions, one position for recharging the power supply, one position for allowing power to flow through the converter from said battery to said external outlet, and one off position, said switch being connected to at least one indicator light.

18. The device of claim 16 wherein said workstation has a computer thereon.

19. The device of claim 16 wherein said housing includes in its interior at least one shelf.

20. The device of claim 16 wherein said horizontal member has a hand-rail located around the periphery of said horizontal member.

* * * * *